United States Patent [19]

Bass

[11] Patent Number: 4,843,401

[45] Date of Patent: Jun. 27, 1989

[54] METHOD AND APPARATUS FOR GENERATING AND RADIATING ELECTROMAGNETIC ENERGY

[75] Inventor: Ronald M. Bass, Houston, Tex.

[73] Assignee: Atlantic Richfield, Los Angeles, Calif.

[21] Appl. No.: 148,672

[22] Filed: Jan. 26, 1988

[51] Int. Cl.[4] ..... H01Q 1/00

[52] U.S. Cl. ..... 343/701; 343/820; 455/129

[58] Field of Search ..... 343/701, 703, 793, 820, 343/803, 850, 860, 862, 863; 333/258, 262; 455/127, 129, 269, 64, 91; 375/37

[56] References Cited

U.S. PATENT DOCUMENTS

| | | | |
|---|---|---|---|
| 3,189,901 | 6/1965 | Cutolo | 455/64 |
| 3,611,146 | 10/1971 | Cooper et al. | 343/701 |
| 3,694,754 | 9/1972 | Baltzer | 343/701 |
| 4,217,468 | 8/1980 | Rice et al. | 343/701 |
| 4,631,736 | 12/1986 | Yamanoue et al. | 455/127 |

OTHER PUBLICATIONS

Halliday and Resnick, *Physics, Part II*, 2d Ed., Chapter 39, pages 971–974, John Wylie and Sons, 1962.

*Primary Examiner*—William L. Sikes
*Assistant Examiner*—Michael C. Wimer
*Attorney, Agent, or Firm*—Geoffrey A. Mantooth; Arthur F. Zobal; James C. Fails

[57] ABSTRACT

The invention pertains to a method and apparatus for generating and radiating electromagnetic energy for use in heating the upper atmosphere. For such an application, the cost per watt is a dominant design factor. The invention minimizes the cost per watt by minimizing the number of active devices utilized. A single active device is used to charge and discharge a short circuited antenna at a rate which is essentially the same as the antenna's resonant frequency.

20 Claims, 1 Drawing Sheet

METHOD AND APPARATUS FOR GENERATING AND RADIATING ELECTROMAGNETIC ENERGY

FIELD OF THE INVENTION

The invention relates to improved methods and apparatuses for generating and radiating electromagnetic energy over a narrow frequency range for use in modifying the electrical characteristics of portions of the atmosphere.

BACKGROUND OF THE INVENTION

The ionosphere is a region of the earth's atmosphere beginning at about thirty miles above the earth's surface and extending up to about two hundred sixty miles. The ionosphere includes bands of free ions and electrons existing in sufficient quantities to effect the direction of electromagnetic wave travel. This characteristic of the ionosphere is utilized to propagate certain frequencies of radio waves for long distance radio communication.

It is known that the ionosphere can be modified in certain respects by heating it with powerful radio waves beamed up from the ground. Ionospheric heating provides a useful tool for aeronomy (the study of the upper atomsphere and especially of the ionized gas regions) and for the study of communications pathways. See, for example, G. Meltz and F.W. Perkins, "Ionospheric Modification Theory: Past, Present, and Future", *Radio Science,* Nov. 1974, pp..885–888, and G. Meltz, L. H. Holway, Jr., and N. M. Tomljanovich, "Ionospheric Heating By Powerful Radio Waves", Radio Science, Nov. 1974, pp. 1049–1063.

In heating the ionosphere, enormously large amounts of continuous rf energy are required. The rf energy need only be at one frequency and no modulation is necessary. Due to the large amounts of rf energy that are required, a single transmitter is not feasible; instead distributed transmitter sources, having large numbers of transmitter units, are utilized. In designing the basic transmitter unit, the large number of transmitter units causes the cost per watt to become a dominant design factor. The number and type of active devices used in the transmitter unit have a significant impact on the cost per watt. Thus, there is a need for a transmitter unit that minimizes the number of active devices so that large numbers of the units can be inexpensively built.

The object of the present invention is to provide an inexpensive method and apparatus for generating and radiating electromagnetic energy for use in modifying the electrical characteristics of portions of the atmosphere.

DESCRIPTION OF PREFERRED EMBODIMENT(S)

Figure 1:
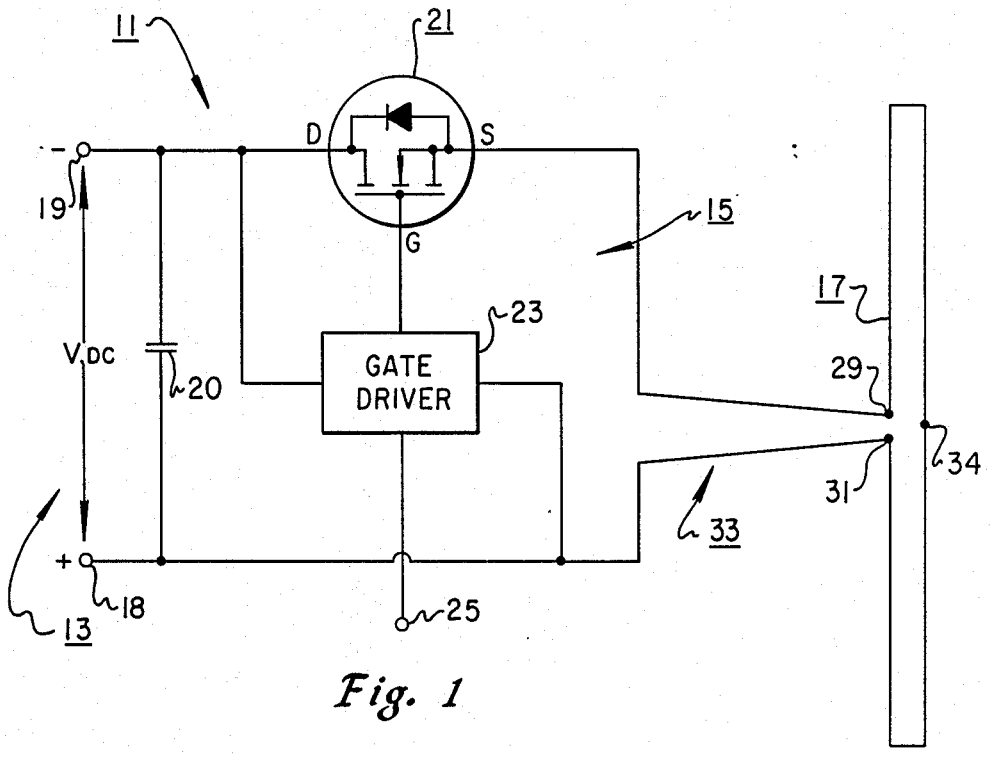
FIG. 1 is a schematic electrical circuit diagram showing an apparatus for generating and radiating electromagnetic energy of the present invention, in accordance with a preferred embodiment.

In FIG. 1, there is shown a schematic electrical circuit diagram of an apparatus 11 for generating and radiating electromagnetic energy in accordance with a preferred embodiment of the present invention. This embodiment is sometimes hereinafter referred to as the short circuit apparatus 11. The apparatus 11 includes an input port 13, switching means 15, and a radiating member 17.

The input port has positive and negative terminals 18, 19. A dc input voltage is applied across the positive and negative terminals 18, 19 and a filter capacitor 20 is connected across the positive and negative terminals.

The switching means 15 includes a power field effect transistor 21 and conventional gate driver means 23. The transistor 21 is connected in series with the radiating member 17 such that the drain D is connected to the negative terminal 19 of the input port, the source S is connected to the radiating member 17, and the gate G is connected to the gate driver means 23. The transistor 21 could, for example, be a Motorola MTE 40N60 type which is capable of switching up to twenty-four kilowatts every full cycle. This type of transistor is used for dc power supply applications and must be repackaged to operate in the desired frequency range (1 to 10 MHz). The gate driver means 23 is powered by connecting it across the positive and negative terminals 18, 19 so as to provide a connection to the input voltage. The gate driver means 23 includes a first stage that detects and amplifies an optical input drive signal applied to the input 25 of the gate driver means and a second stage that provides a gate current sufficient to drive the transistor gate G and cause the transistor 21 to alternate between a conductive state and a non-conductive state.

The radiating member 17 includes radiating elements in the form of a folded dipole antenna 17. The folded dipole antenna 17 has first and second feed inputs 29, 31 and forms a shorted circuit between the first and second feed inputs. The antenna 17 has a resonant frequency that is a function of its length between its feed inputs 29, 31. The antenna 17 may be fabricated by printing metallized strips on flexible insulating material. Such a configuration would allow low cost deployment of large numbers of such antennas. A transmission line 33 is connected between the antenna feed inputs 29, 31 and the switching means 15 to impedance match the antenna 17 to the rest of the circuit. The first input 29 of the folded dipole antenna 17 is connected, through the transmission line 33, to the source S of the transistor 21, and the second input 31 is connected, through the transmission line 33, to the positive input terminal 18. The length of the conductor connecting the source S of the transistor 21 and the transmission line 33 is very short compared to the length of the transmission line and the length of the folded dipole antenna.

The method of generating and radiating electromagnetic energy will now be described. With the input voltage applied across the input port 13, the gate driver means 23 causes the transistor 21 to enter into the conductive state wherein the antenna is connected to the input voltage. When the transistor 21 enters into the conductive state, a pulse of voltage begins to move down through the transmission line 33 and enters the antenna 17 at the feed inputs 29 and 31. The pulse then travels along the antenna 17 to the midway point 34, that is the point midway between the inputs 29, 31, where the voltage pulse is reflected back to the transistor 21 as a negative pulse. When the reflected voltage pulse returns to the transistor source S, the transistor 21 is switched off by the gate driver means 23, wherein it enters into the non-conductive state. The voltage pulse is then reflected back to the antenna 17. Thus, by repetitively switching the transistor between the conductive state and the non-conductive state, at the resonant frequency of the antenna, the antenna is alternately electrically connected to and disconnected from the input voltage and the pulse will oscillate back and forth along the antenna 17, at the resonant frequency of the antenna. The oscillations generate electromagnetic energy, which energy is radiated by the antenna 17.

Figure 2:
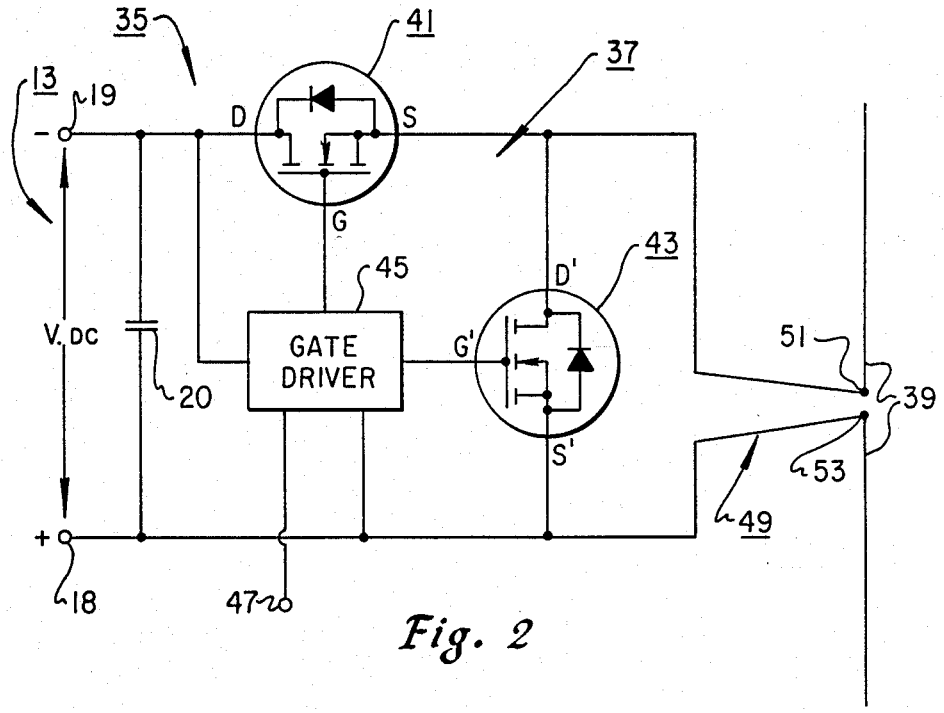
FIG. 2 is a schematic electrical circuit diagram showing an apparatus for generating and radiating electromagnetic energy of the present invention, in accordance with another embodiment.

In FIG. 2, there is shown a schematic electric circuit diagram of an apparatus 35 for generating and radiating electromagnetic energy in accordance with another embodiment of the present invention. This embodiment is sometimes hereinafter referred to as the open circuit apparatus 35. The apparatus 35 includes an input port 13 which is the same as for the short circuit apparatus 11, switching means 37, and a radiating member 39.

The switching means 37 includes first and second power field effect transistors 41, 43 and conventional gate driver means 45. The first transistor 41 is connected in series with the radiating member 39 in the same manner as the transistor 21 in the short circuit apparatus 11. The second transistor 43 is connected across the radiating member 39 such that the drain D' is connected to the source S of the first transistor 41, the source S' is connected to the positive terminal 18 of the input port 13, and the gate G' is connected to the gate driver means 45. An optical input drive signal is applied to the input 47 of the gate driver means 45. the gate driver means 45 is similar to the gate driver means 23 of the short circuit apparatus 11 except that respective outputs are provided to the respective transistor gates G, G'. The gate driver means 45 operates the first and second transistors 41, 43 such that only one transistor can be in a conductive state at any given time.

The radiating member 39 includes radiating elements in the form of a dipole antenna. The dipole antenna 39 forms an open circuit and has a resonant frequency which is a function of its length. A transmission line 49 impedance matches the dipole antenna 39 through its first and second feed inputs 51, 53 to the rest of the circuit. The dipole antenna 39 may be fabricated in the same manner as the folded dipole antenna 17, of the short circuit apparatus 11. The length of the conductors connecting the source S of the first transistor 41 and the drain D' of the second transistor 43 to the transmission line 49 is very short compared to the length of the transmission line 49 and the dipole antenna 39.

The method of generating and radiating electromagnetic energy with the open circuit apparatus 35 will now be described. With the input voltage applied across the input port 13, the gate driver means 45 causes the first transistor 41 to enter into the conductive state, wherein the antenna 39 is connected to the input voltage. The second transistor 43 is in the non-conductive state at this time. A pulse of voltage begins to move down through the transmission line 49 and enters the antenna 39 at the feed inputs 51, 53. When the pulse of voltage reaches the ends of the antenna 39, the first transistor 41 is switched to the non-conductive state and the second transistor 43 is switched to the conductive state. The voltage pulse then travels back to the transistors, wherein the first transistor 41 is switched to the conductive state and the second transistor 43 is switched to the non-conductive state. By repetitively switching the respective transistors between the conductive state and the non-conductive state, such that the state of one transistor is mutually exclusive of the state of the other transistor, the antenna 39 is alternately charged by being connected to the input voltage and discharged. The pulse will oscillate along the antenna 39 wherein electromagnetic energy is radiated.

The method and apparatus of the present invention allows the generation and radiation of rf energy with just one active device, or in the case of the open circuit apparatus of FIG. 2, two active devices. This minimization of active devices in a transmitter enables the construction of large numbers of transmitters for heating the upper atmosphere, at a minimal cost per watt over prior art transmitters.

Having thus described the invention, it will be understood that such description has been given by way of illustration and example and not by way of limitation, reference for the latter purpose being had to the appended claims.

What is claimed is:

1. An apparatus for generating and radiating electromagnetic energy, comprising:

a. a radiating member having feed inputs and radiating elements, said radiating elements being shorted together at a point away from said feed inputs so as to form a shorted circuit, said radiating member having a resonant frequency;

b. an input port having two terminals across which a single polarity input voltage is applied;

c. switching means for switching the application of said input voltage to said feed inputs on and off, said switching means being connected with one of said feed inputs such that said switching means is connected in series with said radiating member, said switching means and said radiating member being connected across said input port terminals such that said input voltage is applied to said radiating member through said switching means, said switching means alternating betwen a conductive state wherein said radiating member is electrically connected to said input voltage and a non-conductive state wherein said radiating member is electrically disconnected from said input voltage;

d. driver means for operating said switching means so as to cause said switching means to switch alternatively between the conductive and non-conductive states at a frequency which is essentially the same as the resonant frequency of said radiating member, said driver means being connected to said switching means.

2. The apparatus of claim 1 wherein said switching means comprises a power field effect transistor with one lead connected with one of the input port terminals and with the other lead connected with one of the feed inputs, the gate of said transistor being connected with said driver means.

3. The apparatus of claim 2 wherein said radiating member comprises a folded dipole antenna.

4. The apparatus of claim 3 further comprising transmission line means connected between said switching means and the feed inputs of said folded dipole antenna, wherein said transmission line means impedance matches said folded dipole antenna.

5. The apparatus of claim 1 wherein said radiating member comprises a folded dipole antenna and said input voltage is a dc voltage.

6. The apparatus of claim 2 wherein said resonant frequency of said radiating member is in the range of 1–10 MHz.

7. An apparatus for generating and radiating electromagnetic energy, comprising:

a. a radiating member having feed inputs and radiating elements, said radiating elements forming an open circuit, said radiating member having a resonant frequency;

b. an input port having two terminals across which a single polarity input voltage is applied;

c. first switching means for switching the application of said input voltage to said feed inputs on and off, said first switching means being connected with one of said feed inputs such that said first switching means is connected in series with said radiating member, said first switching means and said radiating member being connected across said input port terminals such that the input voltage is applied to said radiating member through said first switching means, said first switching means alternating between a conductive state wherein said radiating member is electrically connected to said input voltage, and a non-conductive state wherein said radiating member is electrically disconnected from said input voltage;

d. second switching means for shorting across the feed inputs of said radiating member, said second switching means being connected across said feed inputs so as to be connected in parallel with said radiating member, said second switching means alternating between a conductive state wherein said feed inputs are short circuited to each other and a non-conductive state wherein said feed inputs are open circuited from each other;

e. driver means for operating said first and second switching means so as to cause said respective first and second switching means to switch alternatively between their respective conductive and non-conductive states at a frequency which is essentially the same as the resonant frequency of said radiating member, said driver means having switch control means that prevents one of said switching means from being in its conductive state at the same time the other of said switching means is in its conductive state, said driver means being connected to said first and second switching means.

8. The apparatus of claim 7 wherein said first and second switching means comprise respective first and second power field effect transistors with one lead of the first transistor being connected with one of the input port terminals, the other lead of the first transistor being connected with one lead of the second transistor and with one of the feed inputs, the other lead of the second transistor being connected with the other input port terminal, said respective leads of the second transistor being connected with the respective feed inputs, the respective gates of said first and second transistors being connected with said driver means.

9. The apparatus of claim 8 wherein said radiating member comprises a dipole antenna.

10. The apparatus of claim 9 further comprising transmission line means connected between said first and second switching means and the feed inputs of said dipole antenna, wherein said transmission line means impedance matches said dipole antenna.

11. The apparatus of claim 7 wherein said radiating member comprises a dipole antenna and said input voltage is a dc voltage.

12. The apparatus of claim 8 wherein said resonant frequency of said radiating member is in the range of 1–10 MHz.

13. A method for generating and radiating electromagnetic energy, comprising the steps of:

a. providing a radiating member and switching means connected in series, said radiating member having radiating elements which are shorted together at a point away from feed inputs so as to form a shorted circuit, said radiating member having a resonant frequency, said switching means alternating between open and closed states;

b. applying a single polarity voltage across said switching means and said radiating member;

c. closing said switching means so as to connect said voltage to said radiating member and causing a pulse to enter said radiating member, after a period of time said pulse being reflected back to said switching means;

d. opening said switching means so as to disconnect said voltage from said radiating member when said reflected pulse returns to said switching means and causing the reflection of said pulse back into said radiating member;

e. repeating said closing and opening steps so as to cause the pulse to oscillate along said radiating member, said opening and closing occurring at a frequency such that said pulse oscillates in the radiating member at the radiating member resonant frequency.

14. The method of claim 13 wherein said resonant frequency of said radiating member is in the range of 1-10 MHz.

15. A method for generating and radiating electromagnetic energy, comprising the steps of:

a. providing a radiating member and first switching means connected together in series and second switching means connected in parallel to said radiating member, said radiating member having radiating elements forming an open circuit, said radiating elements having free ends, said radiating member having a resonant frequency, said first and second switching means respectively alternating between open and closed states;

b. applying a single polarity voltage across said first switching means, said radiating member, and said second switching means;

c. closing said first switching means and opening said second switching means so as to connect said voltage to said radiating member and cause a pulse to enter said radiating member;

d. opening said first switching means so as to disconnect said voltage from said radiating member and closing said second switching means so as to short across said radiating member when said pulse reaches the ends of said radiating elements causing said pulse to return to said first and second switching means;

e. closing said first switching means and opening said second switching means when said pulse returns to said first and second switching means;

f. repeating said opening and closing steps so as to cause the pulse to oscillate along said radiating member, said opening and closing occurring at a frequency such that said pulse oscillates in the radiating member at the radiating member resonant frequency.

16. The method of claim 15 wherein said resonant frequency of said radiating member is in the range of 1–10 MHz.

17. An apparatus for generating and radiating electromagnetic energy, comprising:

a. a radiating member having feed inputs and radiating elements, said radiating elements being shorted together at a point away from said feed inputs so as to form a shorted circuit, said radiating member having a resonant frequency;

b. switching means for switching the application of a voltage to said radiating member on and off, said switching means being connected to one of said feed inputs so as to be in series with said radiating member, said switching means alternating between open and closed states;

c. a dc input voltage applied across said switching means and said radiating member;

d. driver means for alternately opening and closing said switching means at a rate which causes a pulse from said input voltage to oscillate along said radiating member at the resonant frequency of said radiating member, said driver means being connected to said switching means.

18. The apparatus of claim 17 wherein said switching means comprises a power field effect transistor.

19. An apparatus for generating and radiating electromagnetic energy, comprising:

a. a radiating member having feed inputs and radiating elements, said radiating elements forming an open circuit, said radiating member having a resonant frequency;

b. first switching means for switching the application of a voltage to said radiating member on and off, said first switching means being connected to one of said feed inputs so as to be in series with said radiating member, said first switching means alternating between open and closed states;

c. second switching means for shorting across the feed inputs of said radiating member, said second switching means being connected across said feed inputs so as to be in parallel with said radiating member and in series with said first switching means, said second switching means alternating between open and closed states;

d. a dc input voltage applied across said first switching means, said radiating member, and said second switching means;

e. driver means for alternately opening and closing said first and second switching means at a rate which causes a pulse from said input voltage to oscillate along said radiating member at the resonant frequency of said radiating member, said driver means having switch control means that prevents one of said switching means from being in its closed state at the same time the other of said switching means is in its closed state, said driver means being connected to said first and second switching means.

20. The apparatus of claim 19 wherein said first and second switching means comprise respective power field effect transistors.

* * * * *